United States Patent [19]

Franzel et al.

[11] Patent Number: 4,825,123

[45] Date of Patent: Apr. 25, 1989

[54] TWO-PIECE CATHODE CUP

[75] Inventors: Patricia E. Franzel, Brookfield; Charles S. Goldsworthy; Peter A. Dillenburg, both of West Allis; James H. Hall, Jr., Mukwonago, all of Wis.

[73] Assignee: General Electric Company, Milwaukee, Wis.

[21] Appl. No.: 948,202

[22] Filed: Dec. 31, 1986

[51] Int. Cl.[4] ..... H01J 9/04

[52] U.S. Cl. ..... 313/452; 445/28; 445/35; 378/136; 378/138

[58] Field of Search ..... 445/28, 35, 36; 313/452, 453; 378/136, 138

[56] References Cited

U.S. PATENT DOCUMENTS

| | | | |
|---|---|---|---|
| 2,686,884 | 8/1954 | Atlee | 378/136 |
| 3,916,202 | 10/1975 | Heiting et al. | 378/138 X |
| 3,943,393 | 3/1976 | Naill | 378/136 |
| 4,035,685 | 7/1977 | Jacob | 378/138 X |
| 4,065,690 | 12/1977 | Maeyama | 378/138 |
| 4,126,805 | 11/1978 | Randall | 378/138 X |
| 4,685,118 | 8/1987 | Furbee et al. | 378/138 X |

FOREIGN PATENT DOCUMENTS

| | | | |
|---|---|---|---|
| 165353 | 9/1984 | Japan | 378/136 |

*Primary Examiner*—Kenneth J. Ramsey
*Attorney, Agent, or Firm*—Douglas E. Stoner

[57] ABSTRACT

Disclosed is a cathode cup for X-ray tubes which is manufactured in two pieces so that the filament can be set before the upper channels are added, thereby, simplifying accurate setting of the filament and minimizing the likelihood of causing scratches or nicks in the outer surface of the cup.

19 Claims, 4 Drawing Sheets

TWO-PIECE CATHODE CUP

BACKGROUND OF THE INVENTION

This invention relates to X-ray tubes and, more particularly, a two-piece cathode cup for X-ray tubes and a method of manufacturing the cups.

Diagnostic X-ray equipment has been in use for many years. During recent years, new types of X-ray equipment have become available, and the standards of performance relating to both those new types of X-ray equipment as well as classical radiographic systems have been upgraded. Many of the improved performance characteristics rely upon X-ray tubes having small focal spots, which in turn require the electron beam within the tube be well controlled and focused. In addition, certain applications and apparatus require that the X-ray beam be grid controlled so that the beam itself, and hence the emission of X-rays, can be interrupted during equipment operation.

The ability to carefully control the electron beam has been dependent upon positioning the electron-emitting filament in what is known as a cathode cup. The cathode cup has beam-focusing surfaces around the filament.

Traditionally, the X-ray tubes are manufactured by setting filaments deep within a recess in one-piece cathode cups. Following this procedure, certain "tabs" are added to provide additional beam-focusing surfaces.

Problems which have been found with this prior-art construction technique include the difficulty of accurately positioning the filament when the assembler must work within the recess. Misaligned filaments negatively affected the precision of beam focus which could be obtained.

Additionally, the requirement that the operator perform the task within the recess sometimes resulted in scratches or nicks on the otherwise smooth outer surface of the cathode cup. Such damage to the cup could cause sharp points of metal. These are significant because X-ray tubes often utilize voltage differences in excess of 100 kv. between the cathode and the anode. As is well known, electric field lines are concentrated near sharp points and, thus, internal arcing can result from the presence of sharp points on the cathode cup.

Finally, the tabs, which had to be set down within the recess in the cathode cup, were sometimes inaccurately set also degrading the tube's beam-focusing performance. In addition, the tabs were made out of thin sheet metal and acted again like sharp points in the high-voltage field.

In a further effort to eliminate sharp points which could cause internal arcing, a covering cap was traditionally used on the back of the cathode cup to cover the filament lead connections. The cap, having a smooth surface, is less likely to cause internal arcing than the sharp points created where the filament leads are spot welded to power supply wires. However, it was found that the cap itself sometimes had sharp edges and, thus, a separate, smooth guard ring was set in place covering the edges of the cap.

It is, therefore, an object of the present invention to provide a method of manufacturing cathode cups which is substantially simpler than the method used heretofore and which is less prone to cause accidental high-voltage discharge within the X-ray tube.

SUMMARY OF THE INVENTION

In accordance with one aspect of the present invention, the cathode cup is more simply and reliably manufactured by utilizing a two-piece structure. First, a filament is set in a lower channel piece which permits the operator to have substantially more access to the filament area during the process of setting the filament. After the filament is set, an upper channel piece is secured in a fixed relationship to the filament and the lower channel piece. The upper channel piece completes the cathode cup such that it functions as did prior art cathode cups but assembly has been rendered far simpler and more accurate by the two-piece cup, inasmuch as the operator has easier access to the area where he must place the filament. Furthermore, since the outer surfaces of the cup are added late in the manufacturing process, they are less likely to be damaged during manufacturing. Therefore, the types of physical damage which could cause inadvertent high-voltage discharge are far less likely to occur.

By another aspect of the present invention, the upper channel piece has its edges softened, or slightly rounded, to further minimize the possibility of inadvertent electrical discharge.

By yet another aspect of the present invention, the upper channel piece includes beam-focusing surfaces which eliminate the need for separately placed tabs. The beam-focusing surfaces can be precisely machined into the upper channel piece and, thus, can be more precisely positioned with respect to the filament than was normally possible with the separate tab pieces.

By still another aspect of the present invention, the upper channel piece covers the edge of the protective cap, as will be explained below. Therefore, no separate guard ring is required by the present invention.

BRIEF DESCRIPTION OF THE DRAWINGS

The features of the invention believed to be novel are set forth with particularity in the appended claims. The invention itself, however, both as to its organization and method of operation, together with further objects and advantages thereof, may best be understood by reference to the following description taken in conjunction with the accompanying drawings in which:

DESCRIPTION OF THE PREFERRED EMBODIMENT

Figure 1:
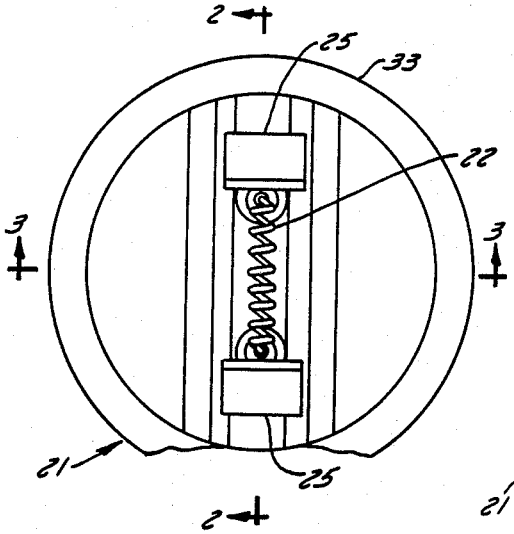
FIG. 1 PRIOR ART
FIGS. 1, 2, and 3 are a plan view and two sectional views of a prior art one-piece cathode cup.
Figure 2:
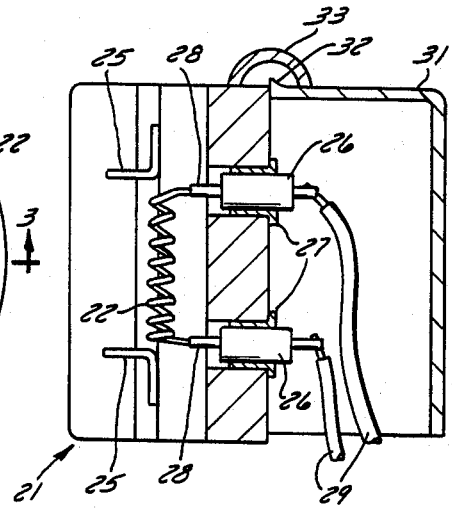
FIG. 2 PRIOR ART
Figure 3:
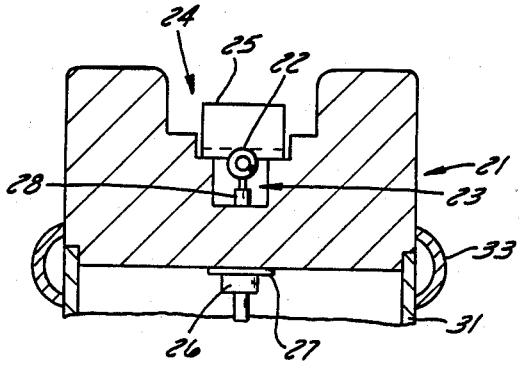
FIG. 3 PRIOR ART

Referring first to FIGS. 1, 2 and 3, there is shown a prior art cathode cup 21. A filament 22 is contained within a recess. The recess includes a T-shaped lower channel 23, which is best seen in FIG. 3, and a wider upper channel 24, also seen in FIG. 3. Set in the lower channel 23 are two tab pieces 25.

During manufacture, two insulators 26 having metal bushings 27 thereon are placed in holes bored in the cup. After the insulators are inserted, the metal flanges 27 are spot welded to the cup. Normally, each end of the filament is crimped into a niobium tube 28. The filament 22 and the niobium tubes 28 are set into the cup as a unit by passing the tubes through metal-lined openings in the center of the insulators 26. After the tubes 28 are positioned, they are spot welded to the metal linings and, thus, the filament 22 is physically secured in place. Leads 29, to supply power to the filament, are later spot welded to the ends of the tubes.

It will be appreciated that even though the tab pieces 25 have not been in position during the process of setting the filament, the proper position of the filament is so far down in lower channel 23 that it is difficult to properly and accurately set the filament, particularly if economics dictate that the job be done quickly.

After the filament is set, the tab pieces 25 are put in place and spot welded. This too can be a difficult procedure, inasmuch as the parts involved are quite small and the positioning requirements are precise.

Finally, a cap 31 is attached to the cathode cup 21. The cap is attached in a conventional manner which is not illustrated in order to preserve clarity of the drawing. Also, the support for the cathode cup is normally brazed thereto. That detail has also been omitted from FIGS. 1–3 in order to preserve clarity.

As shown particularly in FIG. 2, a rough edge 32 can be present on the protective cap 31. Due to the extremely high voltages, often in excess of 100 kv, used in X-ray tubes, the sharp edge 32 can cause internal arcing. In order to prevent this, a guard ring 33 is slipped over the assembly so that it covers the edge 32 of the protective cap 31.

Figure 4:
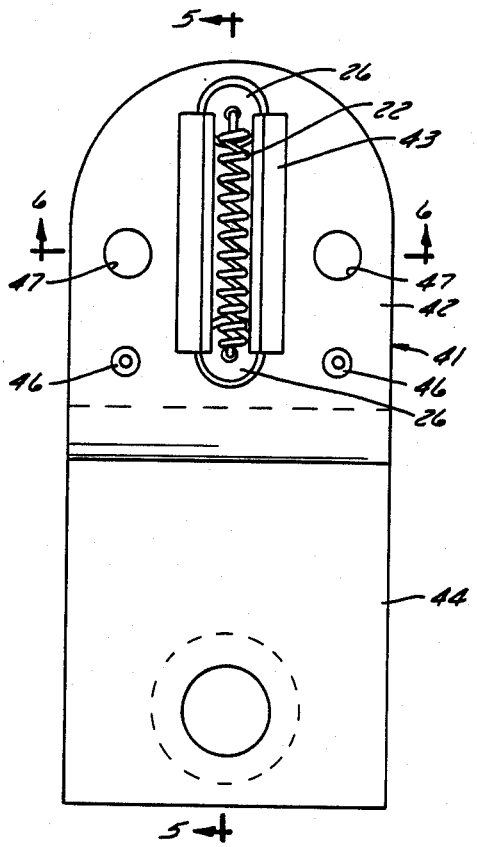
FIGS. 4, 5 and 6 are a plan view and two sectional views of a preferred lower channel piece in accordance with the present invention.
Figure 5:
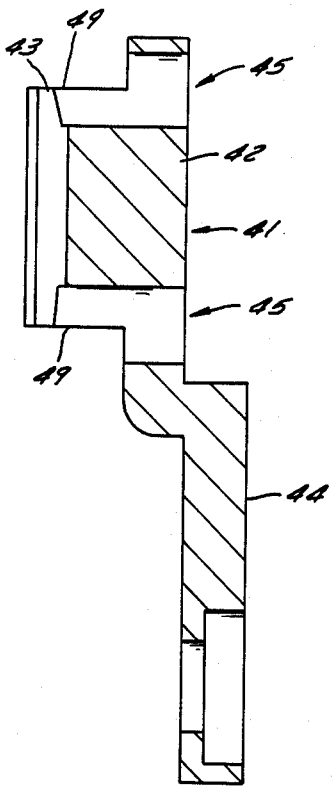
Figure 6:
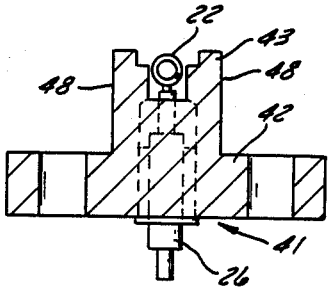

Referring now to FIGS. 4, 5 and 6, there is shown a lower channel piece 41.

The lower channel piece 41 includes a base 42 on which is mounted a channel element 43 which defines a lower channel comparable to the T-shaped lower channel 23 shown in FIG. 3. The base portion 42 and the channel element 43 are shown as being machined from a single piece of metal. That is considered the preferred embodiment, however, there is no need that they be from a single piece of metal. The channel element 43 could be brazed or otherwise attached to a separate base portion 42.

The base portion 42 is also machined from the same piece of metal as is a support portion 44 which facilitates mounting the finished cathode cup in the X-ray tube. However, it should be understood that it is not required that the support portion 44 be machined from the same block of metal as the base portion 42 or the channel element 43. In the preferred embodiment shown where the elements 42, 43 and 44 are all machined from a single piece of metal, high-purity nickel is the preferred material.

Insulators 26 are installed in openings 45 which extend through the base portion 42 into the channel element 43. For purposes of clarity, the insulators 26 and filament 22 are omitted from FIG. 5, and thus the openings 45 are best seen there. The installation of the insulators is like the installation in the conventional cathode cup shown in FIGS. 1 and 2. The filament 26 is set in the insulators just as the filament was set in the insulators in the conventional cup shown in FIGS. 1, 2 and 3.

As is shown most clearly in FIG. 4, the base portion 42 includes two locating holes 46 which receive locating pins, which help position the two pieces of the cathode cup with respect to each other, as will be described below. At the bottom of each hole 46 is a smaller hole which extends through the base portion 42. The purpose of the smaller hole is to vent the hole 46 so that when the cathode cup is later assembled any air present in the hole 46 will be withdrawn during the tube evacuation process. The evacuation hole is made smaller than the hole 46 to create a shoulder on the bottom of the hole 46 to properly retain the locating pin which is to be installed.

Other locating means could be used. For example, two screw holes 47 are included in the base portion 42. Screws passing through these holes will be used to secure the second part of the two-piece structure. The screws themselves could provide a locating function. In addition, the side walls 48 and end walls 49 of the lower channel element could serve as locating walls.

Figure 7:
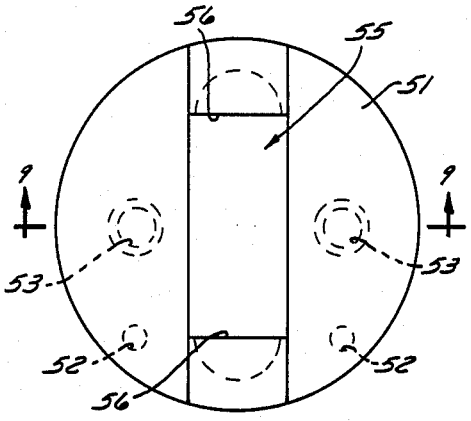
FIGS. 7, 8 and 9 are upper end and lower plan views and a sectional elevation view of an upper channel piece made in accordance with the present invention.
Figure 8:
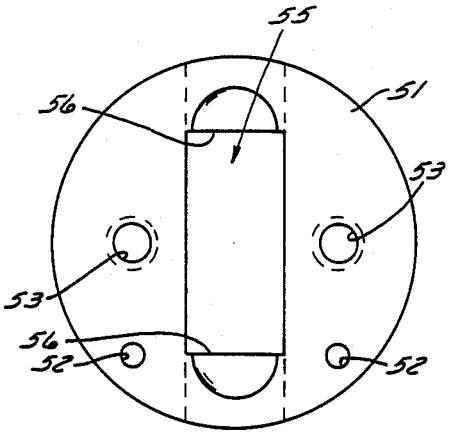
Figure 9:
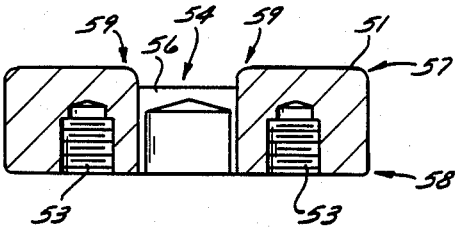

Referring next to FIGS. 7, 8 and 9, there is shown an upper channel piece 51. FIG. 7 is a plan view of the outer side of the upper channel piece 51 and FIG. 8 is a plan view of the lower surface which will ultimately be placed adjacent the base portion 42 of the lower channel piece.

Shown most clearly in FIG. 8 are locating holes 52 that face the locating holes 46 when the assembly is completed. Thus, locating pins spanning from the holes 46 to the holes 52 assure proper positioning of the upper channel piece 51 with respect to the lower channel piece 41, and specifically, with respect to the lower channel element 43.

Shown most clearly in FIGS. 8 and 9 are two threaded screw holes 53 which receive screws which pass through the holes 47 to secure the two elements together. As mentioned previously, the screw holes and the screws can serve the same locating function as the locating pins do, as could the outer faces of the locating element 43 in conjunction with the innerfaces of the central opening in the upper channel piece. However, it is felt that the most precise positioning occurs using the holes 46 and 52 in conjunction with locating pins. Then, screws passing through the holes 47 into the holes 52 can be used solely for physical attachment.

The upper channel 54, which corresponds to the channel 24, is shown most clearly in FIG. 9.

During the manufacture of the upper channel piece 51, two holes are bored from the lower side under what will be the ends of the central opening 55 which receives lower channel element 43. The purpose of these holes is to ensure that there is no interference between the upper channel piece 51 and the insulators 26 and the filament 22 when the upper piece is installed. The holes also permit the ends of the filament to be placed slightly under the upper channel piece 51 so that the ends of the opening 55 can function as beam-focusing surfaces 56. These beam-focusing surfaces eliminate the need for tab pieces 25 in certain X-ray tube configurations.

The upper channel piece 51 is preferably made of a refractory metal, such as a molydenum alloy. Refractory metals are preferred because in the event of an inadvertent arc in the X-ray tube the refractory metal will be less susceptible to damage than would a similar piece made of other, softer metal.

It will be noted that both edges 57 and 58 around the upper and lower peripheries, respectively, and the edges 59 along the upper channel are softened, or slightly rounded. This softening further helps reduce the likelihood of inadvertent arcing in the X-ray tube.

Figure 10:
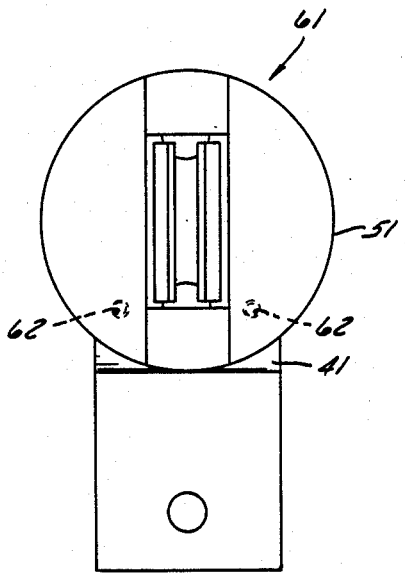
FIGS. 10 and 11 illustrate an assembled cathode cup in accordance with the present invention.
Figure 11:
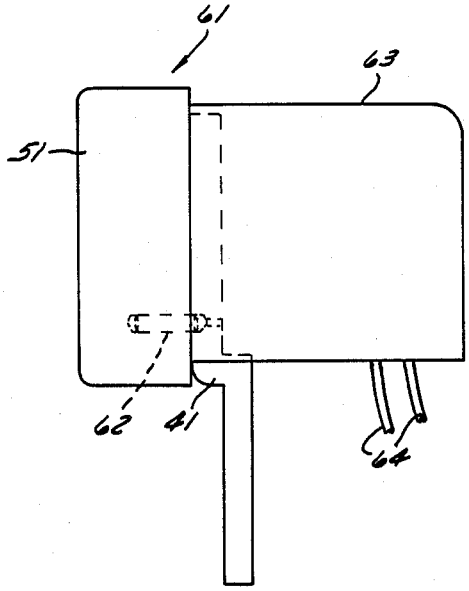

Referring now to FIGS. 10 and 11 there is shown a cathode cup 61 in accordance with the present invention. The lower channel piece 41 has secured to it the upper channel piece 51 by screws passing through the holes 47 into the holes 53 (for clarity, the screws and holes are not shown).

The precise fixed relationship of the filament (not shown in order to preserve clarity) and the lower channel piece with respect to the upper channel piece is established by the locating pins 62, shown in phantom in FIGS. 10 and 11. The pins, of course, are in holes 46 and 52. However, as explained above, other locating methods, such as the screws or the surfaces of the channel pieces could be used. Naturally, if the surfaces 48 and 49 and the inner surface of the opening 55 were to be used for locating, the relationship of those surfaces to each other would be closer than is illustrated in FIG. 10.

To review, assembly of the cathode cup 61 proceeds by installing and spot welding the insulators 26 and then setting the filament as in the conventional manner. However, the task of setting the filament is substantially easier than with a conventional cathode cup, because the upper channel piece 51 is not in place during the filament installation step. Also, as noted above, the upper channel piece itself is less likely to be scratched and nicked and, thus, have sharp, arc-causing defects because it is not present during the early manufacturing stages. Finally, a protective covering cap 63, which is similar to the cap 31, is installed. The exact attachment means for the cap is conventional and has been omitted for purposes of clarity. The cap 63 covers the connections between the power wires 64 and the filament. It will be noted that if the cap 63 does have a sharp edge corresponding to the sharp edge 32 of the cap 31, it is still not likely to cause arcing. That is because the diameter of the upper channel piece is chosen to be large enough that it effectively covers the edge of the cap 63 by projecting past the cap as shown in FIG. 11. Therefore, no guard ring is necessary. The finished cathode cup 61 can be installed in an X-ray tube in the conventional manner using the support portion 44.

While this invention has been described with reference to particular embodiments and examples, other modifications and variations will occur to those skilled in the art in view of the above teachings. Accordingly, it should be understood that within the scope of the appended claims the invention may be practiced otherwise than is specifically described.

The invention claimed is:

1. A method of manufacturing a cathode cup for an X-ray tube comprising the steps of:

setting a filament in a lower channel in a lower channel means, said lower channel means being made of a non-refractory metal; and securing, in a fixed relationship to said filament and lower channel means, an upper channel means having an upper channel which is wider than said lower channel, wherein said upper channel means and said lower channel means are electrically connected, said upper channel means being made of a refractory metal.

2. The method of manufacturing according to claim 1 wherein said upper channel means comprises a beam-focusing surface.

3. The method of manufacturing according to claim 1 wherein said lower channel means is a part of a support means.

4. The method of manufacturing according to claim 1 wherein said lower channel means is high-purity nickel.

5. The method of manufacturing according to claim 1 wherein said upper channel means is a molybdenum alloy.

6. The method of manufacturing according to claim 1 wherein the edges of said upper channel means are softened.

7. The method of manufacturing according to claim 1 wherein said upper and lower channel means comprise locating means.

8. The method of manufacturing according to claim 1 wherein said locating means comprise holes to receive locating pins.

9. The method of manufacturing according to claim 1 comprising the further step of attaching a covering cup to shield the lead of said filament, and wherein said upper channel means covers the edge of said covering cup.

10. A method of manufacturing a cathode cup for an X-ray tube comprising the steps of:

setting a filament in a lower channel in a lower channel means;

securing, in a fixed relationship to said filament and lower channel means, an upper channel means, said upper channel means having softened edges and an upper channel which is wider than said lower channel and has beam-focusing surfaces, and wherein said upper channel means and said lower means channel are electrically connected and wherein the walls of said upper channel extend below and enclose at least the upper portion of the lower channel means.

11. The method of manufacturing according to claim 10 wherein said lower channel means is a part of a support means.

12. The method of manufacturing according to claim 10 comprising the further step of attaching a covering cup to shield the lead of said filament, wherein said upper channel means covers the edge of said covering cup.

13. The method of manufacturing according to claim 12 wherein said upper channel means is a molybdenum alloy.

14. The method of manufacturing according to claim 10 wherein said upper channel means is a molybdenum alloy.

15. The method of manufacturing according to claim 10 wherein said upper and lower channel means comprise locating means.

16. The method of manufacturing according to claim 10 wherein said locating means comprise holes to receive locating pins.

17. A cathode cup comprising:

(a) a lower channel means for retaining a filament in a fixed relationship with a lower beam-forming channel; and (b) an upper channel means which is secured in a fixed relationship to said lower channel means and said filament, said upper channel means having an upper channel which is wider than said lower channel and wherein said upper channel means and said lower channel means are electrically connected, and said upper channel has walls which extend below and enclose at least the upper portion of the lower channel means.

18. A cathode cup according to claim 17 wherein said upper channel means comprises beam-forming surfaces.

19. A cathode cup according to claim 17 wherein said upper channel means comprises a refractory metal.

* * * * *